US010978785B2

(12) United States Patent
Choi et al.

(10) Patent No.: US 10,978,785 B2
(45) Date of Patent: Apr. 13, 2021

(54) CHIP ANTENNA MODULE

(71) Applicant: Samsung Electro-Mechanics., Co., Ltd., Suwon-si (KR)

(72) Inventors: Seong Hee Choi, Suwon-si (KR); Sang Jong Lee, Suwon-si (KR); Sung Yong An, Suwon-si (KR); Jae Yeong Kim, Suwon-si (KR); Ju Hyoung Park, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 122 days.

(21) Appl. No.: 16/456,048

(22) Filed: Jun. 28, 2019

(65) Prior Publication Data

US 2020/0083593 A1 Mar. 12, 2020

(30) Foreign Application Priority Data

Sep. 10, 2018 (KR) ..... 10-2018-0107603
Nov. 9, 2018 (KR) ..... 10-2018-0137297

(51) Int. Cl.

| | |
|---|---|
| ***H01Q 1/24*** | (2006.01) |
| ***H01Q 1/38*** | (2006.01) |
| ***H01Q 13/08*** | (2006.01) |
| ***H01Q 5/10*** | (2015.01) |
| ***H01Q 21/24*** | (2006.01) |
| ***H01Q 9/30*** | (2006.01) |

(52) U.S. Cl.

CPC ..... *H01Q 1/243* (2013.01); *H01Q 1/38* (2013.01); *H01Q 5/10* (2015.01); *H01Q 9/30* (2013.01); *H01Q 13/08* (2013.01); *H01Q 21/24* (2013.01)

(58) Field of Classification Search

CPC ..... H01Q 1/243; H01Q 1/38; H01Q 9/30; H01Q 5/10; H01Q 21/24; H01Q 13/08

See application file for complete search history.

(56) References Cited

U.S. PATENT DOCUMENTS

| | | | | |
|---|---|---|---|---|
| 9,934,459 | B2 * | 4/2018 | Tanaka | G06K 19/025 |
| 10,248,902 | B1 * | 4/2019 | Finn | G06K 19/07722 |
| 10,867,938 | B2 * | 12/2020 | Tang | H01L 21/565 |

(Continued)

FOREIGN PATENT DOCUMENTS

| | | |
|---|---|---|
| EP | 2 421 088 A1 | 2/2012 |
| JP | 3735635 B2 | 1/2006 |

(Continued)

*Primary Examiner* — Graham P Smith
*Assistant Examiner* — Jae K Kim
(74) *Attorney, Agent, or Firm* — NSIP Law

(57) ABSTRACT

An antenna module includes: a board having a first surface including a ground region and a feed region; and chip antennas mounted on the first surface, each of the chip antennas including a first antenna and a second antenna. The first antenna and the second antenna each include a ground portion bonded to the ground region, and a radiation portion bonded to the feed region. A length of a radiating surface of the first antenna is greater than a mounting height of the first antenna, and a mounting height of the second antenna is greater than a length of a radiating surface of the second antenna. A horizontal spacing distance between the radiation portion of the first antenna and the ground region is greater than a horizontal spacing distance between the radiation portion of the second antenna and the ground region.

18 Claims, 12 Drawing Sheets

(56) References Cited

U.S. PATENT DOCUMENTS

| | | | | |
|---|---|---|---|---|
| 2002/0027528 | A1* | 3/2002 | Okabe | H01Q 13/106 343/702 |
| 2004/0004571 | A1* | 1/2004 | Adachi | H01Q 9/0457 343/700 MS |
| 2006/0114159 | A1 | 6/2006 | Yoshikawa et al. | |
| 2007/0003781 | A1* | 1/2007 | de Rochemont | H05K 1/162 428/615 |
| 2007/0013589 | A1 | 1/2007 | Park et al. | |
| 2007/0176827 | A1* | 8/2007 | Itoh | H01Q 21/08 343/700 MS |
| 2007/0236394 | A1* | 10/2007 | Aoyama | H01Q 5/371 343/700 MS |
| 2008/0159363 | A1* | 7/2008 | Rofougaran | H01Q 23/00 375/219 |
| 2008/0198082 | A1* | 8/2008 | Soler Castany | H01Q 13/10 343/770 |
| 2015/0364830 | A1* | 12/2015 | Tong | H01L 23/66 342/27 |
| 2018/0054244 | A1* | 2/2018 | Kim | H04B 7/065 |
| 2018/0062256 | A1* | 3/2018 | Kim | H01Q 13/02 |
| 2018/0358295 | A1* | 12/2018 | de Rochemont | H01G 4/1209 |
| 2019/0326678 | A1* | 10/2019 | Uchimura | H01Q 9/0414 |
| 2020/0091608 | A1* | 3/2020 | Alpman | H01Q 21/24 |
| 2020/0136269 | A1* | 4/2020 | Choi | G06K 19/07775 |
| 2020/0250504 | A1* | 8/2020 | Lotya | H01Q 1/2225 |
| 2020/0343629 | A1* | 10/2020 | Kim | H01Q 1/523 |

FOREIGN PATENT DOCUMENTS

| | | | |
|---|---|---|---|
| JP | 2010-63192 | A | 3/2010 |
| KR | 10-2007-0009199 | A | 1/2007 |
| KR | 10-1178852 | B1 | 9/2012 |

* cited by examiner

VI-VI'

CHIP ANTENNA MODULE

CROSS-REFERENCE TO RELATED APPLICATIONS

This application claims benefit under 35 U.S.C. § 119(a) of Korean Patent Application Nos. 10-2018-0107603 and 10-2018-0137297 filed on Sep. 10, 2018 and Nov. 9, 2018, respectively, in the Korean Intellectual Property Office, the entire disclosures of which are incorporated herein by reference for all purposes.

BACKGROUND

1. Field

The following description relates to a chip antenna module.

2. Description of Related Art

Mobile communications terminals such as mobile phones, PDAs, navigation devices, notebook computers, and the like, supporting radio communications, have been developed to support functions such as CDMA, wireless LAN, DMB, near field communication (NFC), and the like. One important component enabling these functions is an antenna.

Meanwhile, an improved 5G or a spare 5G communication system is being developed to meet increasing demand for wireless data traffic after creation of fourth generation 4G communication systems such as long term evolution LTE.

Fifth generation 5G communication systems are considered to be implemented in higher frequency (mmWave) bands, such as in bands of 10 GHz to 100 GHz, in order to achieve a higher data transmission rate.

In order to decrease propagation loss of radio waves and increase a transmission distance of the radio waves, beamforming, multiple-input multiple output (MIMO), full dimensional MIMO (FD-MIMO), an array antenna, analog beamforming, and large-scale antenna techniques have been considered in relation to 5G communication systems.

However, in millimeter wave communications, to which the 5G communication systems are applied, since the wavelength may be as small as several millimeters, it is difficult to use antennas of the related art. Therefore, an antenna module appropriate for the millimeter wave communications band and having subminiature size such that the antenna module is capable of being mounted on a mobile communications terminal, is desirable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna module includes: a board having a first surface including a ground region and a feed region; and chip antennas mounted on the first surface, each of the chip antennas including a first antenna and a second antenna. The first antenna and the second antenna each include a ground portion bonded to the ground region, and a radiation portion bonded to the feed region. A length of a radiating surface of the first antenna is greater than a mounting height of the first antenna, and a mounting height of the second antenna is greater than a length of a radiating surface of the second antenna. A horizontal spacing distance between the radiation portion of the first antenna and the ground region is greater than a horizontal spacing distance between the radiation portion of the second antenna and the ground region.

The first antenna and the second antenna may be mounted on the substrate in a pair.

The board may include feed pads disposed in the feed region and bonded to the radiation portion. An outline of the ground region in an area facing the pair may be formed in a straight line. A distance between a feed pad, among the feed pads, to which the radiation portion of the first antenna is bonded and the ground region may be greater than a distance between a feed pad, among the feed pads, to which the radiation portion of the second antenna is bonded and the ground region.

The first surface may further include a device mounting portion on which an electronic device is mounted. The device mounting portion may be disposed inside the ground region.

The board may include feed pads disposed in the feed region and bonded to the radiation portion. The feed pads may be electrically connected to the electronic device.

A distance between a feed pad, among the feed pads, on which the first antenna is mounted and the ground region may be different from a distance between a feed pad, among the feed pads, on which the second antenna is mounted and the ground region.

An entire body portion of the first antenna may be disposed to face the feed region.

The first antenna may be configured to transmit and receive a horizontal polarization. The second antenna may be configured to transmit and receive a vertical polarization.

The feed region may be disposed along an edge of the board.

The chip antennas may be configured for radio communications in a frequency band of gigahertz, may be configured to receive a feed signal of a signal processing device, and may be configured to radiate the feed signal externally. The first antenna and the second antenna may each further include a hexahedron-shaped body portion having a dielectric constant, and including a first surface and a second surface opposing the first surface. The radiation portion may have a hexahedral shape and may be coupled to the first surface. The ground portion may have a hexahedral shape and may be coupled to the second surface.

The board may include feed pads disposed in the feed region and bonded to the radiation portion. The ground region may extend in a region facing the second antenna toward a feed pad, among the feed pads, to which the second antenna is bonded.

The board may include feed pads disposed in the feed region and bonded to the radiation portion, and ground pads disposed in the ground region and bonded to the ground portion. An outline of the ground region may be disposed adjacent to a feed pad, among the feed pads, to which the second antenna is bonded in a region facing the second antenna, and may be disposed adjacent to a ground pad, among the ground pads, to which the first antenna is bonded in a region facing the first antenna.

An outline segment of the ground region disposed between the first antenna and the second antenna may have a linear shape or an arcuate shape.

Horizontal spacing distances may be formed between the radiation portion of the first antenna and the ground region in an area of the ground region facing the first antenna.

In another general aspect, an antenna module includes: a board having a first surface including a ground region and a feed region; and chip antennas mounted on the first surface, each of the chip antennas including a first antenna and a second antenna. The first antenna and the second antenna may each include a ground portion bonded to a respective ground pad disposed in the ground region, and a radiation portion bonded to a respective feed pad disposed in the feed region. The first antenna may be configured to transmit and receive a horizontal polarization, and the second antenna may be configured to transmit and receive a vertical polarization. A horizontal spacing distance between the feed pad to which the radiation portion of the first antenna is bonded and the ground region may be greater than a horizontal spacing distance between the feed pad to which the radiation portion of the second antenna is bonded and the ground region.

The first antenna and the second antenna may be mounted on the board in a pair.

The first antenna and the second antenna may each further include a body portion formed of a dielectric material and disposed between the ground portion and the radiation portion.

A portion of the ground region that faces the body portion of the first antenna may be smaller than a portion of the ground region that faces the body portion of the second antenna.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
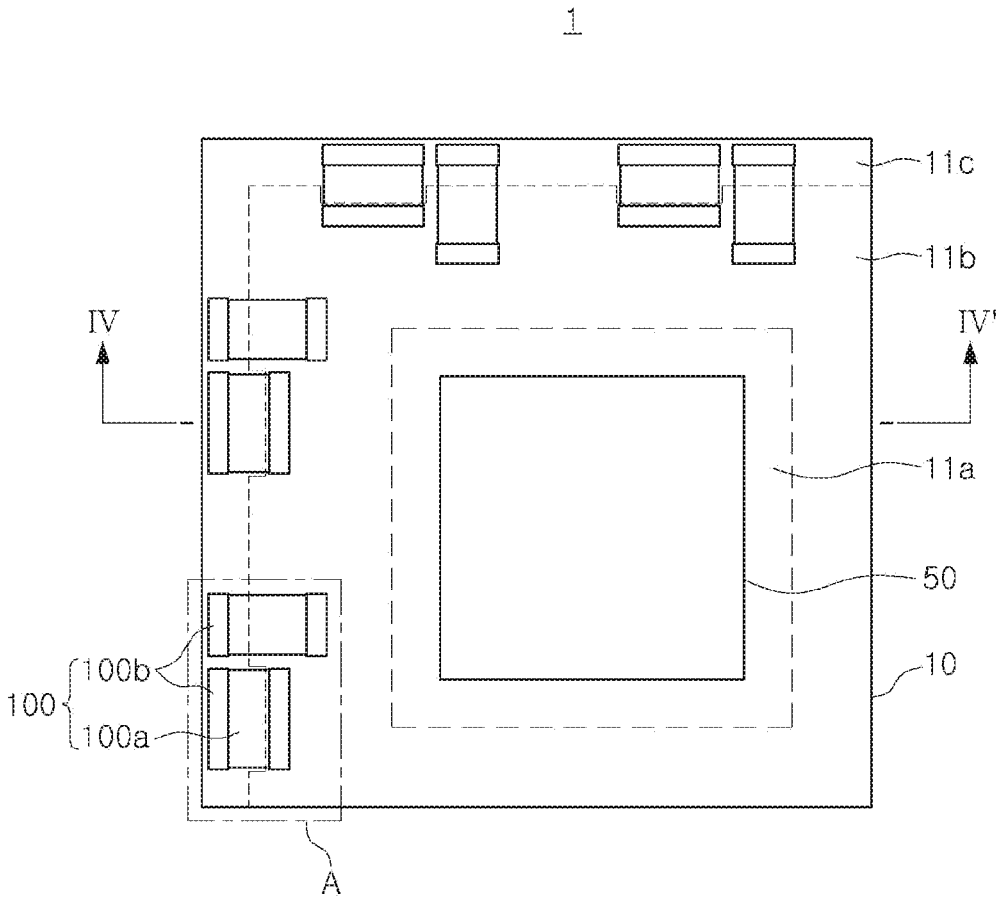
FIG. 1 is a plan view of a chip antenna module, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

In addition, in the following specification, terms "upper side", "lower side", "side surface", and the like, are represented based on the drawings and may be differently represented when directions of corresponding targets are changed.

The terminology used herein is for describing various examples only, and is not to be used to limit the disclosure. The articles "a," "an," and "the" are intended to include the plural forms as well, unless the context clearly indicates otherwise. The terms "comprises," "includes," and "has"

specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

A chip antenna module describe herein may operate in a high frequency region, and may operate in a frequency band of, for example, 3 GHz or more and 30 GHz or less. In addition, the chip antenna module described herein may be mounted in an electronic device configured to receive or transmit and receive radio signals. For example, a chip antenna may be mounted in a mobile phone, a portable laptop computer, a drone, or the like.

Figure 2:
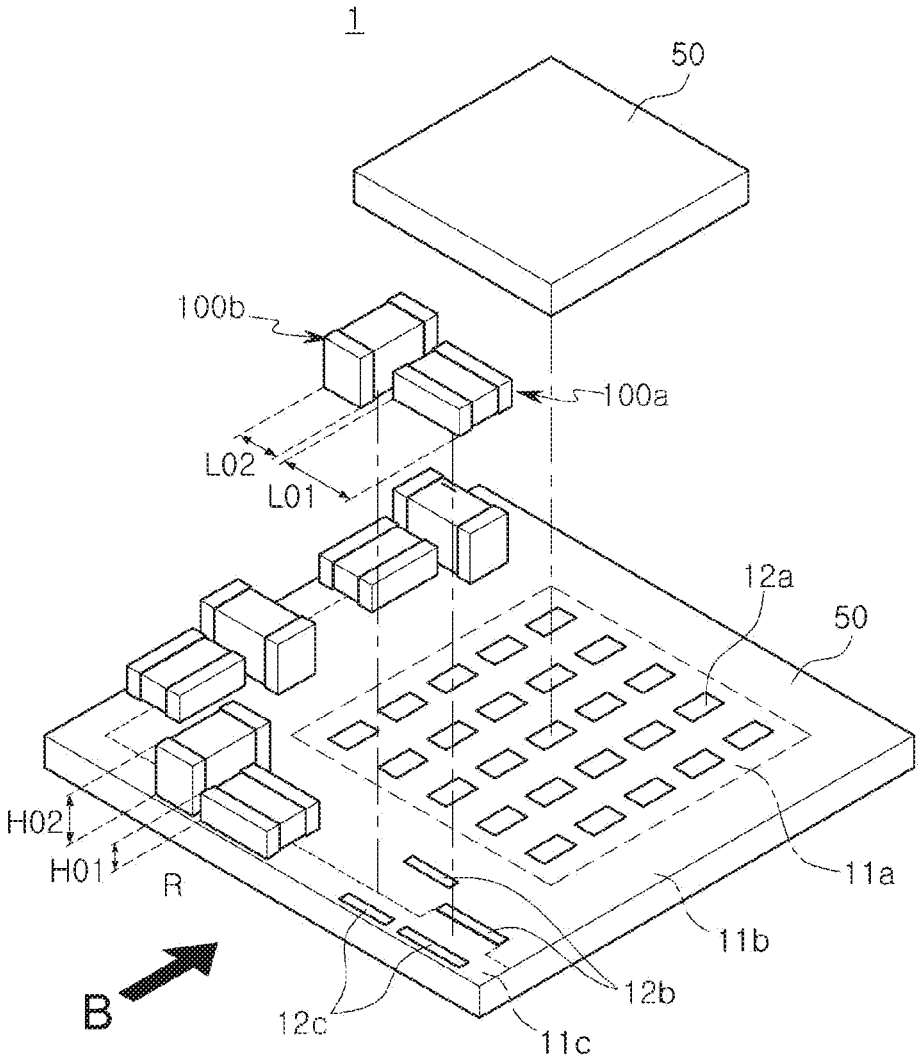
FIG. 2 is an exploded perspective view of the chip antenna module illustrated in FIG. 1.
Figure 3:
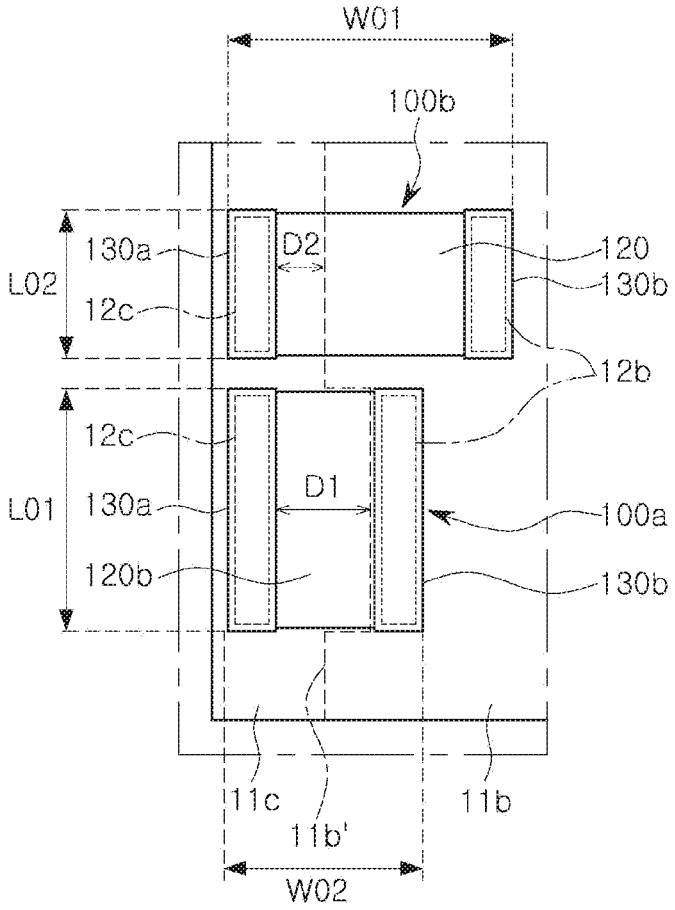
FIG. 3 is an enlarged view of portion A of FIG. 1.

FIG. 1 is a plan view of a chip antenna module 1, according to an embodiment. FIG. 2 is an exploded perspective view of the chip antenna module 1. In addition, FIG. 3 is an enlarged view of portion A of FIG. 1, and FIG. 4 is a cross-sectional view taken along IV-IV' of FIG. 1.

Referring to FIGS. 1 to 4, the chip antenna module 1 may include a board 10 and an electronic device 50, and a chip antenna 100.

The board 10 may be a circuit board on which a circuit or an electronic component that is necessary for a radio antenna is mounted. For example, the board 10 may be a PCB containing one or more electronic components therein or having one or more electronic components mounted on a surface thereof. Therefore, the board 10 may be provided with circuit wirings electrically connecting the electronic components to each other.

Figure 4:
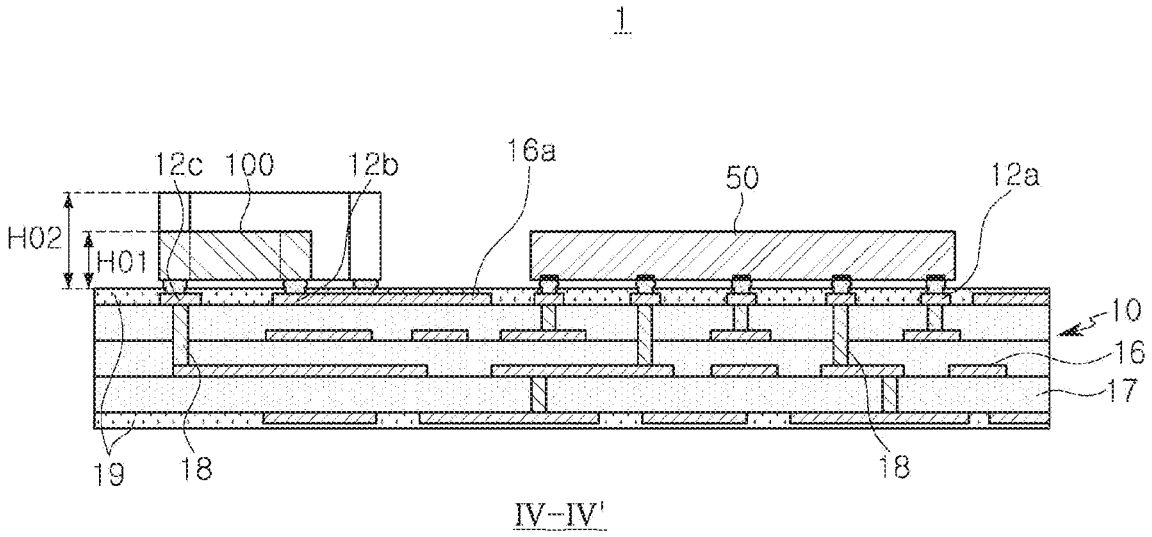
FIG. 4 is a cross-sectional view taken along IV-IV' of FIG. 1.

As shown in FIG. 4, the board 10 may be a multilayer board formed by repeatedly stacking a plurality of insulating layers 17 and a plurality of wiring layers 16. However, if necessary, a double-sided board on which wiring layers are formed on two opposite surfaces of one insulating layer may also be used.

A material of an insulating layer 17 is not particularly limited. For example, a thermosetting resin such as an epoxy resin, a thermoplastic resin such as polyimide, or a resin impregnated with a core material such as a glass fiber (a glass fiber, a glass cloth, and a glass fabric) together with an inorganic filler, for example, an insulating material such as a prepreg, an Ajinomoto Build-up Film (ABF), FR-4, or bismaleimide triazine (BT) may be used for the insulating layer 17. As required, a photo imageable dielectric (PID) resin may be used.

The wiring layers 16 may electrically connect the electronic device 50 and the chip antennas 100, which will be described later, to each other. In addition, the wiring layers 16 may electrically connect the electronic device 50 or the chip antennas 100 externally.

Copper (Cu), aluminum (Al), silver (Ag), tin (Sn), gold (Au), nickel (Ni), lead (Pb), titanium (Ti) or a conductive material such as an alloy of Cu, Al, Ag, Sn, Au, Ni, Pb, or Ti may be used as a material of the wiring layers 16.

Interlayer connection conductors 16 for connecting the wiring layers 16 in a stacked configuration may be disposed inside the insulating layers 17.

In addition, an insulating protective layer 19 may be disposed on upper and lower surfaces of the board 10. The insulating protective layer 19 may be disposed to cover the upper surfaces of the uppermost insulating layer 17 and the uppermost wiring layer 16 and the lower surfaces of the lowermost insulating layer 17 and the lowermost wiring layer 16. Thus, the wiring layer 16 disposed on the upper surface or the lower surface of the insulating layer 17 may be protected.

The insulating protective layer 19 may have openings exposing at least a portion of the uppermost wiring layer 16 and the lowermost wiring layer 16. The insulating protective layer 19 may include an insulating resin and an inorganic filler, but may not include a glass fiber. For example, a solder resist may be used as the insulating protective layer 19, but the insulating wiring layer 19 is not limited to being formed of a solder resist.

Various kinds of boards 10 (for example, a printed circuit board, a flexible board, a ceramic board, a glass board, and the like) well-known in the art may be used as the board 10.

As illustrated in FIG. 2, a first surface, which may be an upper surface of the board 10, may be divided into a device mounting portion 11*a*, a ground region 11*b*, and a feed region 11*c*.

The device mounting portion 11*a*, a region on which the electronic device 50 is mounted, may be disposed inside the ground region 11*b* to be described below. A plurality of connection pads 12*a* to which the electronic device 50 is electrically connected may be disposed in the device mounting portion 11*a*.

The ground region 11*b*, which is a region on which a ground layer 16*a* is disposed, may be disposed to surround the device mounting portion 11*a*. Therefore, the device mounting portion 11*a* may be disposed inside the ground region 11*b*.

One of the wiring layers 16 of the board 10 may be configured as the ground layer 16*a*. For example, the ground layer 16*a* may be disposed on the surface (uppermost or lowermost surface) of the insulating layer 17 or between two insulating layers 17, which are stacked one on top of the other.

In the illustrated embodiment, the device mounting portion 11*a* may be formed to have a rectangular shape. Therefore, the ground region 11*b* may be disposed to surround the device mounting portion 11*a* in a form of a rectangular ring shape. However, the disclosure is not limited to such a configuration.

Since the ground region 11*b* is disposed along a circumference of the device mounting portion 11*a*, the connection pad 12*a* of the device mounting portion 11*a* may be electrically connected to an external device or other components through interlayer connection conductors 18 penetrating through the insulating layers 17 of the board 10 (see FIG. 4).

A plurality of ground pads 12*b* may be formed in the ground region 11*b*. The ground pad 11*b* may be formed by partially opening an insulating protective layer (not shown) covering the ground layer 16*a*. Therefore, in this case, the ground pad 12*b* may be configured as a portion of the ground layer 16*a*. However, the disclosure is not limited to this example, and when the ground layer 16*a* is disposed between two insulating layers 17, the ground pad 12*b* may be disposed on the upper surface of the uppermost insulating layer 17, and the ground pad 12*b* and the ground layer 16*a* may be connected to each other through the interlayer connection conductor 18.

The ground pads 12*b* may be disposed in pairs with respective feed pads 12*c* to be described later. Therefore, the ground pad 12*b* may be disposed adjacent to the feed pad 12*c*, and be disposed in parallel with the feed pad 12*c*.

The feed region 11*c* may be disposed outside the ground region 11*b*. In the illustrated embodiment, the feed region 11*c* may be formed outside two sides formed by the ground region 11*b*. Therefore, the feed region 11*c* may be disposed along a corner of the board 10. However, the disclosure is not limited to such a configuration.

A plurality of feed pads 12*c* may be disposed in the feed region 11*c*. The feed pad 12*c* may be disposed on the surface of the uppermost insulating layer 17, and a radiation portion 130*a* (FIG. 5) of the chip antenna 100 may be bonded to the feed pad 12*c*.

The feed pad 12*c* may be electrically connected to the electronic device 50 or other components through the interlayer connection conductor 18, which penetrates through the insulating layer(s) 17 of the board 10 and the wiring layer 16.

The device mounting region 11*a*, the ground region 11*b*, and the feed region 11*c* may be defined depending on a shape or a position of the ground layer 16*a* in the board 10 configured as described above. In addition, connection pads 12*a*, ground pads 12*b*, and feed pads 12*c* may be exposed externally in the form of a pad through the opening in which the insulating protective layer 19 is removed.

The electronic device 50 may be mounted on a device mounting portion 11*a* of the substrate 10. The electronic device 50 may be bonded to the connection pad 12*a* of the device mounting portion 11*a* via a conductive adhesive such as a solder.

Although a case in which one electronic device 50 is mounted is described as an example in the present embodiment, a plurality of electronic devices 50 may be mounted, as required.

The electronic device 50 may include at least one active device and may include, for example, a signal processing device configured to apply a signal to a feeding portion of an antenna. In addition, the electronic device 50 may include a passive device as required.

The chip antenna 100 may be used for radio communication in a gigahertz frequency band, and may be mounted on the board 10 to receive a feed signal from the electronic device 50 and radiate the feed signal externally.

The chip antenna 100 may be formed to have a hexahedral shape as a whole, and both ends of the chip antenna 100 may be bonded to the feed pad 12*c* and the ground pad 12*b* of the substrate 10, respectively, via the conductive adhesive such as a solder, and mounted on the substrate 10.

Figure 5:
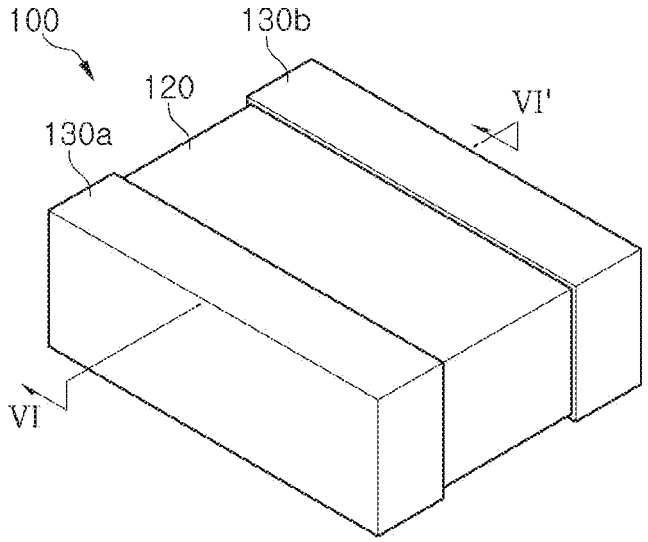
FIG. 5 is an enlarged perspective view of the chip antenna illustrated in FIG. 1.
Figure 6:
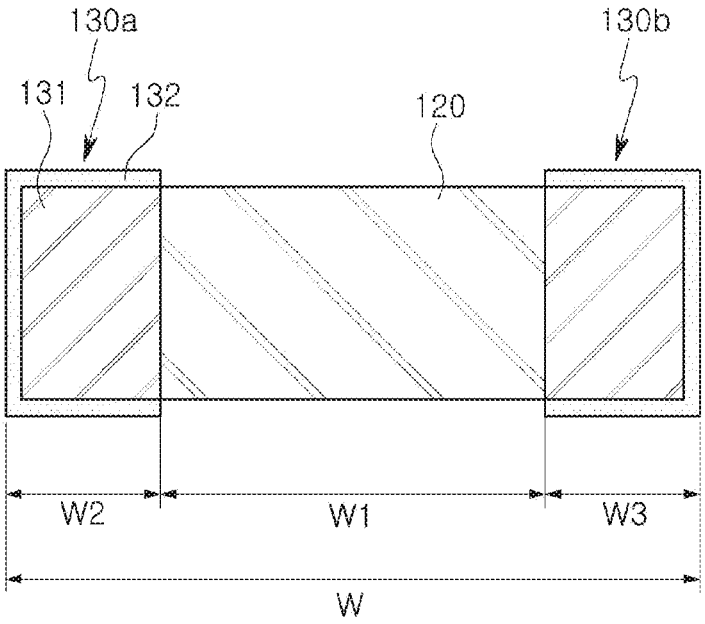
FIG. 6 is a cross-sectional view taken along line VI-VI' of FIG. 5.

FIG. 5 is an enlarged perspective view of the chip antenna 1. FIG. 6 is a cross-sectional view taken along line VI-VI' of FIG. 5. FIG. 6 is a cross-sectional view taken along line VI-VI' of FIG. 5.

Referring to FIGS. 5 and 6, the chip antenna 100 may include a body portion 120, a radiation portion 130*a*, and a ground portion 130*b*.

The body portion 120 may have a hexahedral shape and may be formed of a dielectric substance. For example, the body portion 120 may be formed of a polymer having a dielectric constant, or may be formed of a ceramic sintered body.

In the described embodiment, a chip antenna used in a 3 GHz to 30 GHz band is taken as an example.

A wavelength(λ) of an electromagnetic wave in a band of 3 GHz to 30 GHz may be 100 mm to 0.75 mm, and a length of an antenna may theoretically be λ, λ/2, and λ/4. Therefore, the length of the antenna should be configured to be approximately 50 mm to 25 mm. However, as in the described embodiment, when the body portion 120 is formed of a material having a dielectric material having a higher dielectric constant than air, and the length of the antenna may be remarkably reduced.

The body portion 120 of the chip antenna 100 may be formed of a material having a dielectric constant of 3.5 to 25. In this case, the maximum length of the chip antenna 100 may be in a range of 0.5 to 2 mm.

When the dielectric constant of the body portion 120 is less than 3.5, a distance between the radiation portion 130*a* and the ground portion 130*b* should be increased for the chip antenna 100 to operate normally.

As a test result, it was determined that in a case in which the dielectric constant of the body portion 120 is less than 3.5, the chip antenna 100 performed a normal function in the band of 3 GHz to 30 GHz when a maximum width W was 2 mm or more. However, in this case, an overall size of the chip antenna 100 may be increased, such that it is difficult to mount the chip antenna 100 in a thin portable device.

Therefore, the length of the longest side of the chip antenna 100 may be 2 mm or less in consideration of the length of the wavelength and the mounting size. For example, the length of the chip antenna 100 may be 0.5 to 2 mm, in order to adjust a resonance frequency in the above-described frequency band.

In addition, when the dielectric constant of body portion 120 exceeds 25, a size of the chip antenna needs to be decreased to 0.3 mm or less. In this case, it was measured that antenna performance was rather deteriorated.

Therefore, the body portion 120 of the chip antenna 100 may be formed of a dielectric having a dielectric constant greater than or equal to 3.5 and less than or equal to 25.

However, the disclosure is not limited to the above examples, and the size of the chip antenna 100 and the dielectric constant of the body portion 120 may be changed according to the frequency band in which the chip antenna 100 is used.

The radiation portion 130*a* may be coupled to a first surface of the body portion 120. The ground portion 130*b* may be coupled to a second surface to the body portion 120. Here, the first surface and the second surface of the body portion 120 may mean two surfaces facing opposite directions from the body portion 120 formed as a hexahedron.

Referring to FIG. 6, a width W1 of the body portion 120 may be a distance between the first surface and the second surface. Therefore, a direction facing the second surface from the first surface of the body portion 120 (or a direction facing the first surface from the second surface of the body portion 120) may be defined as a width direction of the body portion 120 or the chip antenna 100.

In addition, widths W2 and W3 of the radiation portion 130*a* and the ground portion 130*b* may each be a distance in the width direction of the chip antenna. Therefore, the width W2 of the radiation portion 130*a* may be the shortest distance from a bonding surface of the radiation portion 130*a* bonded to the first surface of the body portion 120 to an opposite surface of the radiation portion 130*a* the bonding surface, and the width W3 of the ground portion 130*b* may be the shortest distance from a bonding surface of the ground portion 130*b* bonded to the second surface of the body portion 120 to an opposite surface of the ground portion 130*b*.

The radiation portion 130*a* may be in contact with only one of six surfaces of the body portion 120, and may be coupled to the body portion 120. Similarly, the ground portion 130*b* may be also in contact with only one of the six surfaces of the body portion 120, and may be coupled to the body portion 120.

The radiation portion 130*a* and the ground portion 130*b* may not be disposed on surfaces other than the first and second surfaces of the body portion 120, and may be disposed parallel to each other with the body portion 120 interposed therebetween.

In a conventional chip antenna used in a low frequency band, a radiation portion and a ground portion may be disposed in a thin film form on a lower surface of the body portion. In this case, since a distance between the radiation portion and the ground portion is close to each other, a loss due to inductance may be generated. In addition, since it is difficult to precisely control the distance between the radiation portion and the ground portion in the manufacturing process, accurate capacitance may not be predicted, and it is difficult to adjust a resonance point, which makes tuning of the impedance difficult.

However, in the chip antenna 100, the radiation portion 130*a* and the ground portion 130*b* may be coupled to the first surface and the second surface of the body portion 120, respectively. In the illustrated embodiment, the radiation portion 130*a* and the ground portion 130*b* may each be formed to have a hexahedral shape, and one surface of the hexahedrons may be bonded to the first surface and the second surface of the body portion 120, respectively.

When the radiation portion 130*a* and the ground portion 130*b* are bonded only to the first surface and the second surface of the body portion 120, a spacing distance between the radiation portion 130*a* and the ground portion 130*b* may be defined only by the size of the body portion 120, such that all of the above-described problems may be solved.

In addition, since the chip antenna 100 has capacitance due to a dielectric (for example, a body portion) disposed between the radiation portion 130*a* and the ground portion 130*b*, a coupling antenna may be designed or a resonant frequency may be tuned, using the dielectric.

The radiation portion 130*a* and the ground portion 130*b* may be formed of the same material. In addition, the radiation portion 130*a* and the ground portion 130*b* may be formed in the same shape and the same structure. In this case, the radiation portion 130*a* and the ground portion 130*b* may be classified according to a type of a pad to be bonded thereto when mounting the radiation portion 130*a* and the ground portion 130*b* on the board 10.

For example, in the chip antenna 100, a portion bonded to the feed pad 12*c* of the board 10 may function as the radiation portion 130*a*, and a portion bonded to the ground pad 12*b* of the board 10 may function as the ground portion 130*b*. However, the disclosure is not limited to such a configuration.

The radiation portion 130*a* and the ground portion 130*b* may include a first conductor 131 and a second conductor 132.

The first conductor 131 may be a conductor directly bonded to the body portion 120 and may be formed to have a block shape. The second conductor 132 may be formed to have a layer shape along a surface of the first conductor 131.

The first conductor 131 may be formed on one surface of the body portion 120 through a printing process or a plating process, and may be formed of any one selected from Ag, Au, Cu, Al, Pt, Ti, Mo, Ni, and W or alloys of any two or more selected from Ag, Au, Cu, Al, Pt, Ti, Mo, Ni, and W. In addition, the first conductor 131 may also be formed of a conductive paste or a conductive epoxy in which an organic material such as a polymer or a glass is contained a metal.

The second conductor 132 may be formed on the surface of the first conductor 131 through the plating process. The second conductor 132 may be formed by sequentially stacking a nickel (Ni) layer and a tin (Sn) layer or sequentially stacking a zinc (Zn) layer and a tin (Sn) layer, but is not limited to these examples.

The chip antenna 100 configured as described above may include a first antenna 100*a* and a second antenna 100*b*.

The first antenna 100*a* and the second antenna 100*b* may have different mounting heights H01 and H02 as illustrated in FIGS. 2 and 4. Specifically, the mounting height H02 of the second antenna 100*b* may be larger than the mounting height H01 of the first antenna 100*a*. In this example, the mounting heights H01 and H02 may be a distance from a mounting surface of the board 10 to an upper surface of the chip antenna 100. A length L01 of the radiation portion 130*a* of the first antenna 100*a* may be formed to be longer than a length L01 of the radiation portion 130*a* of the second antenna 100*b*.

The lengths L01 and L02 of the radiation portion 130*a* may be a transverse length of a radiating surface R (a surface disposed to face the outside of the board 10) while the chip antenna 100 is mounted on the board 10.

Accordingly, when viewed in a direction of B of FIG. 2, the first antenna 100*a* may be formed such that the length L01 of the radiating surface of the first antenna 100*a* is greater than the mounting height H01 (or thickness). The second antenna 100*b* may be formed such that the mounting height H02 (or thickness) is greater than the length L02 of the radiating surface.

Generally, in the antenna, a region in which current is distributed may differ depending on the shape of the conductor of an antenna radiation portion when transmitting/receiving signals. The antenna may be classified into a horizontal polarization and a vertical polarization based on a direction of a polarized wave surface (or an electric field) of radio waves and a ground surface.

A radio wave in which a polarized wave surface is radiated horizontally with respect to a ground surface may be a horizontal polarization, and a radio wave in which a polarized wave surface is radiated vertically with respect to a ground surface may be a vertical polarization.

In the embodiment described herein, since a radiating surface R of the first antenna 100*a* is disposed long in a horizontal direction with respect to the ground layer 16*a*, current distribution may be performed in the horizontal direction. Therefore, the first antenna 100*a* may be used as an antenna for horizontal polarization. In addition, since a radiation surface R of the second antenna 100*b* is disposed long in a vertical direction with respect to the ground layer 16*a*, current distribution may be performed in the vertical direction. Therefore, the second antenna 100*b* may be used as an antenna for vertical polarization.

In the chip antenna 100, first antennas 100*a* and second antennas 100*b* may be mounted on the board 10 in pairs. Therefore, the antenna for vertical polarization and the antenna for horizontal polarization are disposed in a pair, and, accordingly, radiation performance of the antenna module 1 may be improved.

Referring to FIG. 3, an overall width W01 of the first antenna 100*a* may be less than an overall width W02 of the second antenna 100*b*. However, the present disclosure is not limited to this configuration, and the overall width W01 of the first antenna 100*a* and the overall width W02 of the second antenna 100*b* may be the same, or the overall width W01 of the first antenna 100*a* may be greater than the overall width W02 of the second antenna 100*b*. As described above, various modifications are possible as needed.

Since the first antenna 100*a* and the second antenna 100*b* are configured to transmit/receive different polarized waves, in the antenna module 1, the first antenna 100*a* and the second antenna 100*b* may need to be designed for each polarization.

When the chip antenna 100 is mounted along an outer periphery of the board 10 as in the disclosed embodiment, antenna characteristics may be changed according to the distance between the ground region 11*b* and the radiation portion 130*a* (or the feed pad).

Therefore, in order for both the first antenna 100*a* and the second antenna 100*b* to smoothly transmit/receive the horizontal polarization and the vertical polarization, there is need to optimize the distance between the ground region 11*b* and the radiation portion 130*a*.

Thus, a horizontal spacing distance D1 (hereinafter, referred to as a first distance) between the radiation portion 130 of the first antenna 100*a* and the ground region 11*b* may be greater than a horizontal spacing distance D2 (hereinafter, referred to as a second distance) between the radiation portion 130*a* of the second antenna 100*b* and the ground region 11*b*. Since the radiation portion 130*a* is bonded to the feed pad 12*c*, the horizontal spacing distance between the radiation portion 130*a* and the ground region 11*b* may be understood as a horizontal spacing distance between the feed pad 12*c* and the ground region 11*b*.

As illustrated in FIG. 3, an entire first distance D1 may be longer than a second distance D2.

As shown in FIG. 3, the ground region 11*b* may be disposed in a region facing the ground portion 130*b* of the first antenna 100*a*, and may have a removed (e.g., recessed) shape in a region in which the body portion 120 and the board 10 face each other. Therefore, the ground region 11*b* may be hardly disposed in the region in which the board 10 faces the body portion 120 of the first antenna 100*a*. For example, the entire body portion 120 of the first antenna 100*a* may be disposed to face the feed region 11*c*.

Still referring to FIG. 3, an outline 11*b*' of the ground region 11*b* in the region in which the first antenna 100*a* and the board 10 face each other may be disposed along a boundary of the ground portion 130*b* of the first antenna 100*a* and the body portion 120 and may be disposed at a position adjacent to the boundary.

The second antenna 100*b* may be configured such that half or more of the body portion 120 faces the ground region 11*b*.

However, the disclosure is not limited to the foregoing examples, and various modifications are possible. For example, the first antenna 100*a* may be configured such that half of the body portion 120 faces the ground region 11*b*, and the second antenna 100*b* may be configured such that a region exceeding half of the body portion 120 faces the ground region 11*b*. Various modifications may be possible within a range in which the first distance D1 is larger than the second distance D2.

Since the first distance D1 and the second distance D2 are differently configured as described above, the antenna module 1 may improve an antenna gain.

Figure 14:
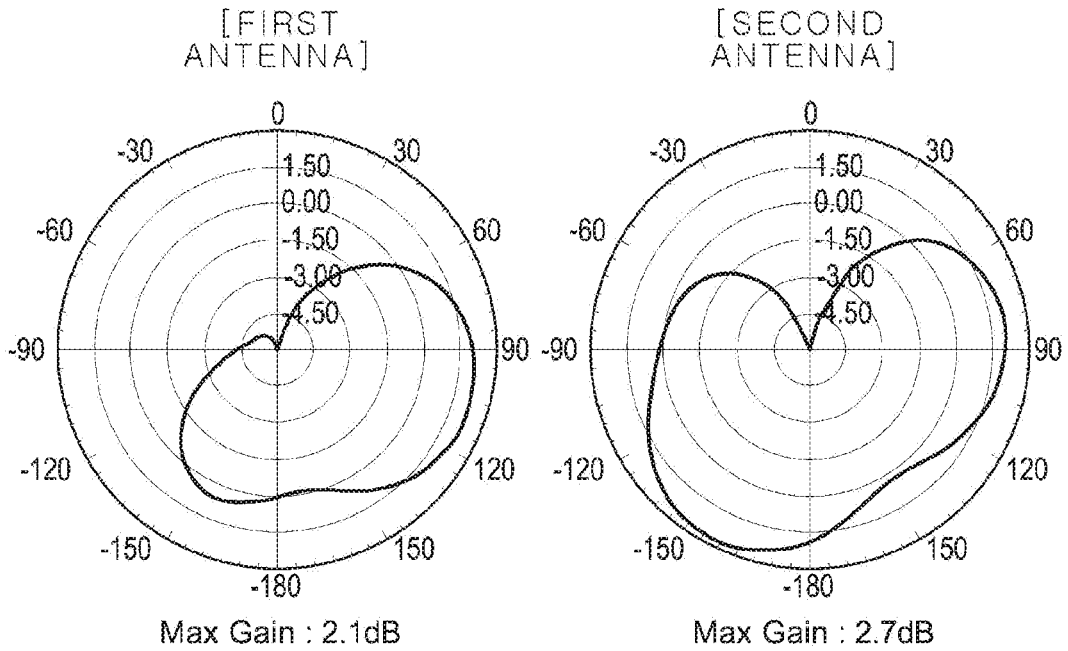
FIGS. 14 and 15 are graphs illustrating radiation patterns of the chip antenna module.
Figure 15:
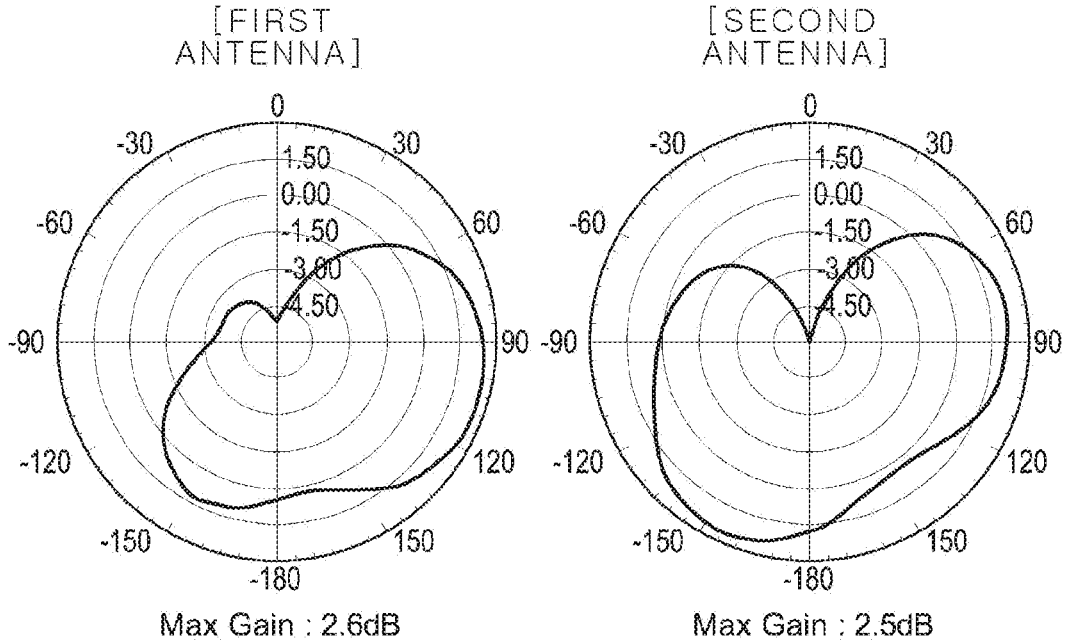

FIGS. 14 and 15 are graphs illustrating measurement results of radiation patterns of a chip antenna module. FIG. 14 is a graph illustrating a measurement result of a radiation pattern of the chip antenna 100 by configuring the first distance D1 and the second distance D2 to be the same, with reference to FIG. 3. FIG. 15 is a graph illustrating a measurement result of a radiation pattern of the chip antenna 100 by configuring the first distance D1 to be greater than the second distance D2, as illustrated in FIG. 3.

When the first distance D1 and the second distance D2 were the same, it was measured, as illustrated in FIG. 14, that a maximum gain of the first antenna 100*a* was 2.1 dB, and a maximum gain of the second antenna 100*b* was 2.7 dB. When the first distance was configured to be larger than the second distance D2, it was measured, as illustrated in FIG. 15, that a maximum gain of the first antenna 100*a* was 2.6 dB, and a maximum gain of the second antenna 100*b* was 2.5 dB.

Therefore, it was confirmed that, when the first distance D1 is greater than the second distance D2, a gain of the second antenna 100*b* may be somewhat reduced, but the gain of the first antenna 100*a* may be greatly improved.

In the case of the antenna module for radio communications, the maximum gain of the chip antenna may be required to be 2.5 dB or more for smooth operation. Therefore, as illustrated in FIG. 14, when the maximum gain of the first antenna 100*a* is 2.1 dB or more, radio communications may not be performed smoothly.

On the other hand, in the antenna module 1 in which the first distance D1 is configured to be larger than the second distance D2, it can be known that the maximum gains of the first antenna 100*a* and the second antenna 100*b* are all 2.5 dB or more, as illustrated in FIG. 15, such that the radio communications may be performed smoothly.

The disclosure is not limited to the above-described embodiments, and various modifications may be made as illustrated in FIGS. 7 to 12.

FIGS. 7 to 12 are views illustrating chip antennas, according to embodiments, which illustrate planes corresponding to FIG. 3.

Figure 7:
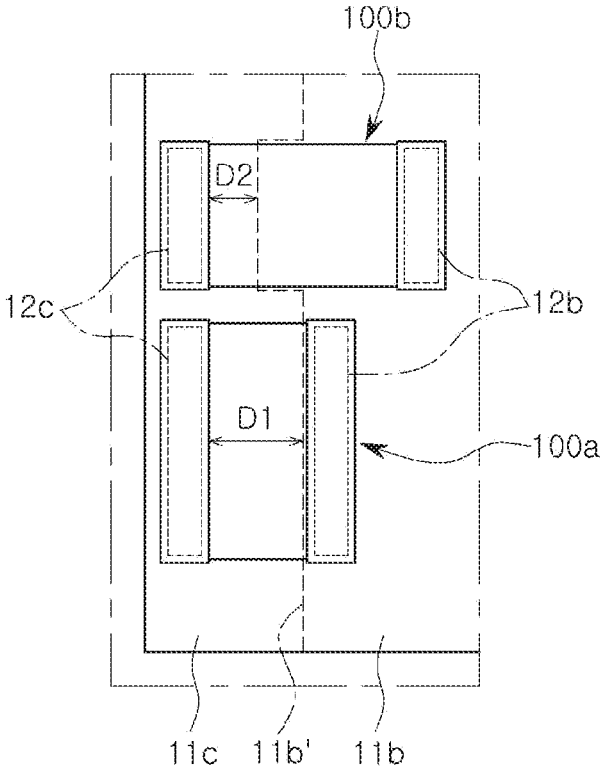
FIGS. 7 to 12 are views illustrating chip antennas according to embodiments.

Referring to FIG. 7, an area of the ground region 11*b* facing the second antenna 100*b* may extend toward the feed pad 12*c* farther than other areas of the ground region 11*b*. Thus, since the second distance D2 between the second antenna 100*b* and the ground region 11*b* is reduced, as compared to the first distance D1 between the first antenna 100*a* and the ground region 11*b*, the first distance D1 may be configured to be larger than the second distance D2.

Figure 8:
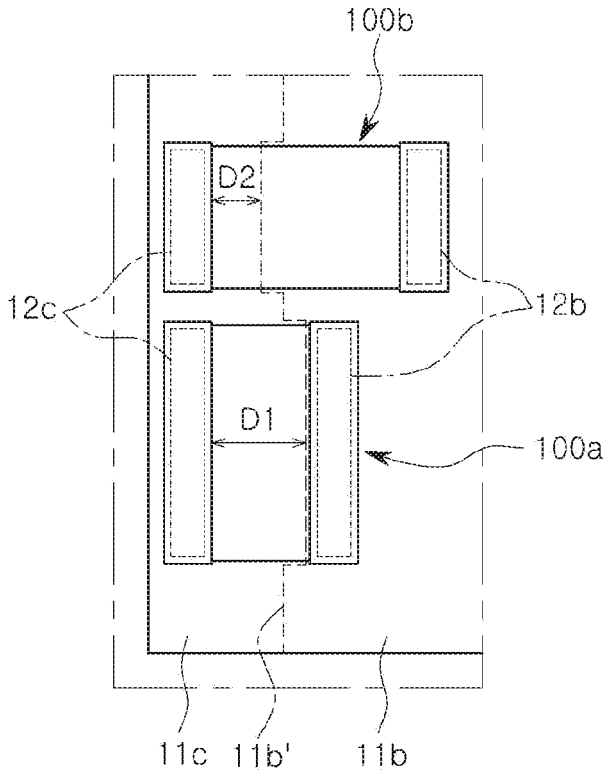

FIG. 8, a configuration of a combination of the above-described FIGS. 3 and 7. In FIG. 8, the outline 11*b*' of the ground region 11*b* may be disposed adjacent to the feed pad 12*c* to which the second antenna 100*b* is bonded in the region facing the second antenna 100*b*, and may be disposed adjacent to the ground pad 12*b* to which the first antenna 100*a* is bonded in the region facing the first antenna 100*a*.

Therefore, the first distance D1 between the radiation portion 130*a* of the first antenna 100*a* and the ground region 11*bn* may be increased, and the second distance D2 between the radiation portion 130*a* of the second antenna 100*b* and the ground region 11*b* may be reduced.

Figure 9:
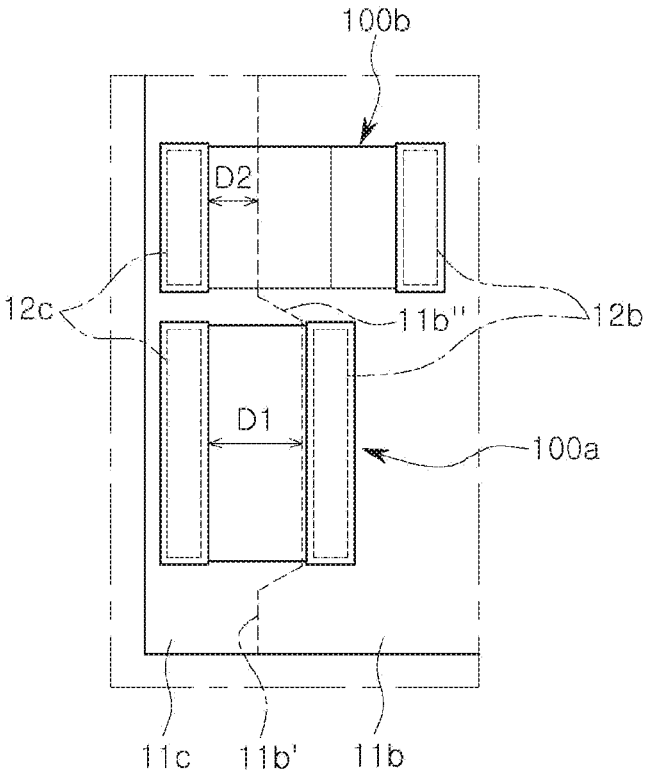
Figure 10:
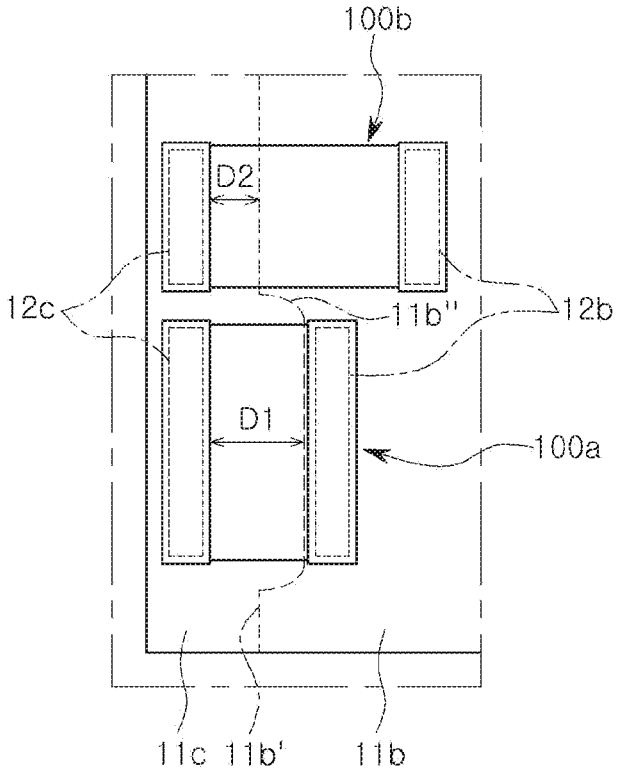

Referring to FIGS. 9 and 10, the ground region 11*b* may be configured to be similar to the ground region 11*b* illustrated in FIG. 3, and may be configured differently from a portion not facing the chip antenna 100 of the ground region 11*b*. An outline segment 11*b*" of the ground region 11*b* that is disposed between the first antenna 100*a* and the second antenna 11*b* may have a linear shape or an arcuate shape.

FIG. 9 illustrates a case in which the ground region 11*b* is formed such that the outline segment 11*b*" of the ground region 11*b* disposed between the first antenna 100*a* and the second antenna 100*b* has a linear shape, and FIG. 10 illustrates a case in which the ground region 11*b* is formed such that the outline segment 11*b*" of the same ground region 11*b* has an arcuate shape.

When the shape of the outline segment 11*b*" of the ground region 11*b* disposed between the chip antennas 100 is deformed, since the horizontal spacing distance between the radiation portion 130*a* of the first antenna 100*a* and the ground region 11*b* around the first antenna 100*a* is changed, an antenna gain may be adjusted.

Figure 11:
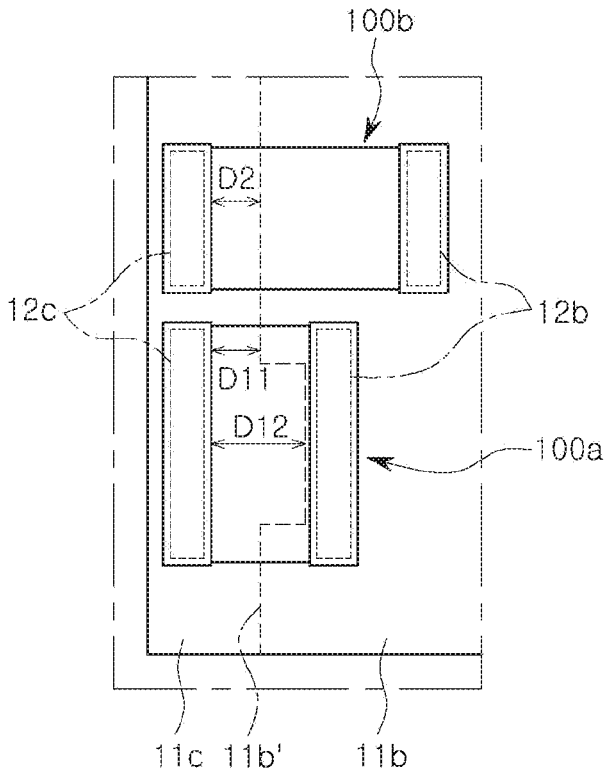

Referring to FIG. 11 the ground region 11*b* may be disposed to partially face the body portion 120 of the first antenna 100*a*. Therefore, the ground region 11*b* may be partially disposed even on a lower portion of the body portion 120 of the first antenna 100*a*.

In this case, a plurality of horizontal spacing distances D11 and D12 may be formed between the radiation portion 130*a* of the first antenna 100*a* and the ground region 11*b*. At least one D12 of the plurality of horizontal spacing distances D11 and D12 may be formed to be larger than the second distance D2.

In the above-described embodiments, the feed pad 12*c* to which the first antenna 100*a* is bonded and the feed pad 12*c* to which the second antenna 100*b* is bonded may be disposed on a straight line, and the first distance D1 and the second distance D2 may be differently configured by changing the position of the outline 11*b*' of the ground region 11*b*.

Figure 12:
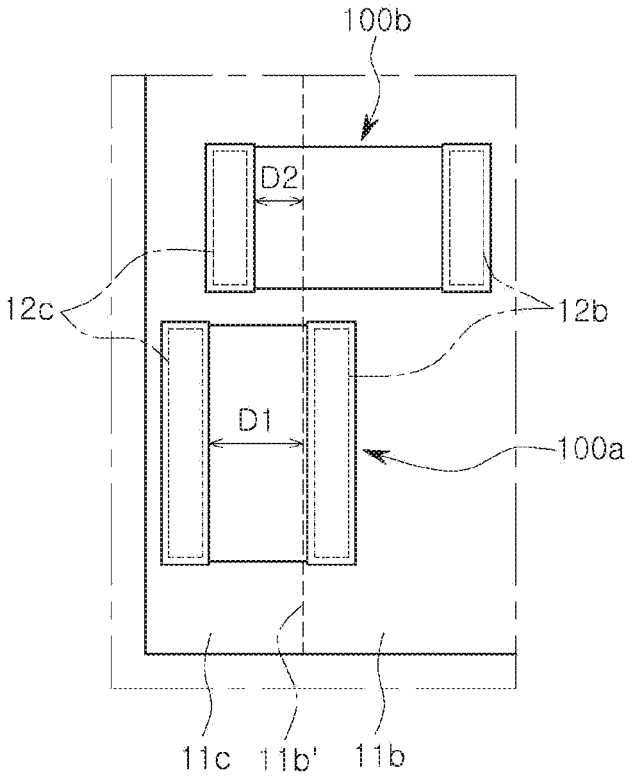

However, in the antenna module illustrated in FIG. 12, the outline 11*b*' of the ground region 11*b* may be formed in a straight line, and the first distance D1 and the second distance D2 may be differently configured by changing the position of the feed pad 12*c*. More specifically, the feed pad 12*c* to which the second antenna 100*b* is bonded may be moved to the ground region 11*b*.

Therefore, the feed pad 12*c* to which the second antenna 100*b* is bonded may be disposed closer to the ground region 11*b* than the feed pad 12*c* to which the first antenna 100*a* is bonded, and thus, the first distance D1 may be greater than the second distance D2.

The chip antenna module 1 may have both the antenna for horizontal polarization and the antenna for vertical polarization, and a distance between the feed pad and the ground region of the antenna for horizontal polarization may be different than a distance between the feed pad and the ground region of the antenna for vertical polarization. Therefore, radiation efficiency of the chip antenna 100 may be increased.

Figure 13:
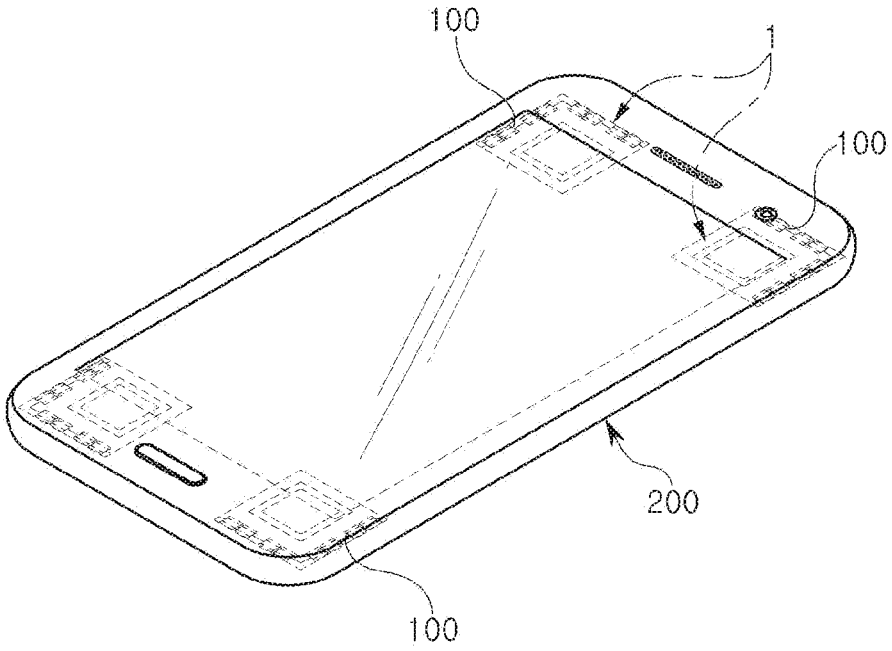
FIG. 13 is a schematic perspective view illustrating a portable terminal on which a chip antenna module is mounted.

FIG. 13 is a schematic perspective view illustrating a portable terminal 200 on which chip antenna modules 1 are mounted.

Referring to FIG. 13, the chip antenna module 1 may be disposed at a corner of a portable terminal 200. In this case, in the chip antenna module 1, the chip antenna 100 may be disposed adjacent to the corner of the portable terminal 200.

A case in which the chip antenna module 1 are disposed at all four corners of the portable terminal 200 is illustrated in FIG. 13 as an example, but the disclosure is not limited to this example. When an internal space of the portable terminal 200 is insufficient, a dispositional structure of the chip antenna module 1, such as disposing only two chip antenna modules in a diagonal direction of the portable terminal 200, and the like, may be modified into various forms as needed.

In addition, in the chip antenna module 1, the feed region 11*c* of FIG. 1) may be coupled to be disposed adjacent to an edge of the portable terminal 200. The radio waves radiated through the first antenna 100*a* of the chip antenna module 1 may be radiated in a direction of a surface of the portable terminal 200 toward the outside of the portable terminal 200 from the corner portion of the portable terminal 200. The radio wave radiated through the second antenna 100*b* may be radiated in a thickness direction of the portable terminal 200.

As set forth above, the chip antenna modules according to the present disclosure may have both an antenna for horizontal polarization and an antenna for vertical polarization, and a distance between the radiation portion and a ground region of the antenna for horizontal polarization, and a distance between the antenna for vertical polarization may be configured differently. Therefore, the radiation efficiency of the chip antenna 100 may be increased.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna module, comprising:

a board having a first surface comprising a ground region and a feed region; and chip antennas mounted on the first surface, the chip antennas comprising a first antenna and a second antenna, wherein the first antenna and the second antenna each comprise a ground portion bonded to the ground region, and a radiation portion bonded to the feed region, wherein a length of a radiating surface of the first antenna is greater than a mounting height of the first antenna, and a mounting height of the second antenna is greater than a length of a radiating surface of the second antenna, and wherein a horizontal spacing distance between the radiation portion of the first antenna and the ground region is greater than a horizontal spacing distance between the radiation portion of the second antenna and the ground region.

2. The antenna module of claim 1, wherein the first antenna and the second antenna are mounted on the substrate in a pair.

3. The antenna module of claim 2, wherein the board comprises feed pads disposed in the feed region and bonded to the radiation portion, wherein an outline of the ground region in an area facing the pair is formed in a straight line, and wherein a distance between a feed pad, among the feed pads, to which the radiation portion of the first antenna is bonded and the ground region is greater than a distance between a feed pad, among the feed pads, to which the radiation portion of the second antenna is bonded and the ground region.

4. The antenna module of claim 1, wherein the first surface further comprises a device mounting portion on which an electronic device is mounted, and wherein the device mounting portion is disposed inside the ground region.

5. The antenna module of claim 4, wherein the board comprises feed pads disposed in the feed region and bonded to the radiation portion, and wherein the feed pads are electrically connected to the electronic device.

6. The antenna module of claim 5, wherein a distance between a feed pad, among the feed pads, on which the first antenna is mounted and the ground region is different from a distance between a feed pad, among the feed pads, on which the second antenna is mounted and the ground region.

7. The antenna module of claim 1, wherein an entire body portion of the first antenna is disposed to face the feed region.

8. The antenna module of claim 1, wherein the first antenna is configured to transmit and receive a horizontal polarization, and the second antenna is configured to transmit and receive a vertical polarization.

9. The antenna module of claim 1, wherein the feed region is disposed along an edge of the board.

10. The antenna module of claim 1, wherein the chip antennas are configured for radio communications in a frequency band of gigahertz, are configured to receive a feed signal of a signal processing device, and are configured to radiate the feed signal externally, wherein the first antenna and the second antenna each further comprise a hexahedron-shaped body portion having a dielectric constant, and comprising a first surface and a second surface opposing the first surface, wherein the radiation portion has a hexahedral shape and is coupled to the first surface, and wherein the ground portion has a hexahedral shape and is coupled to the second surface.

11. The antenna module of claim 1, wherein the board comprises feed pads disposed in the feed region and bonded to the radiation portion, and wherein the ground region extends in a region facing the second antenna toward a feed pad, among the feed pads, to which the second antenna is bonded.

12. The antenna module of claim 1, wherein the board comprises feed pads disposed in the feed region and bonded to the radiation portion, and ground pads disposed in the ground region and bonded to the ground portion, and wherein an outline of the ground region is disposed adjacent to a feed pad, among the feed pads, to which the second antenna is bonded in a region facing the second antenna, and is disposed adjacent to a ground pad, among the ground pads, to which the first antenna is bonded in a region facing the first antenna.

13. The antenna module of claim 1, wherein an outline segment of the ground region disposed between the first antenna and the second antenna has a linear shape or an arcuate shape.

14. The antenna module of claim 1, wherein horizontal spacing distances are formed between the radiation portion of the first antenna and the ground region in an area of the ground region facing the first antenna.

15. An antenna module, comprising:

a board having a first surface comprising a ground region and a feed region; and chip antennas mounted on the first surface, the chip antennas comprising a first antenna and a second antenna;

wherein the first antenna and the second antenna each comprise a ground portion bonded to a respective ground pad disposed in the ground region, and a radiation portion bonded to a respective feed pad disposed in the feed region, wherein the first antenna is configured to transmit and receive a horizontal polarization, and the second antenna is configured to transmit and receive a vertical polarization, and wherein a horizontal spacing distance between the feed pad to which the radiation portion of the first antenna is bonded and the ground region is greater than a horizontal spacing distance between the feed pad to which the radiation portion of the second antenna is bonded and the ground region.

16. The antenna module of claim 15, wherein the first antenna and the second antenna are mounted on the board in a pair.

17. The antenna module of claim 15, wherein the first antenna and the second antenna each further comprise a body portion formed of a dielectric material and disposed between the ground portion and the radiation portion.

18. The antenna module of claim 17, wherein a portion of the ground region that faces the body portion of the first antenna is smaller than a portion of the ground region that faces the body portion of the second antenna.

* * * * *